US007746299B2

(12) United States Patent
Aoki et al.

(10) Patent No.: US 7,746,299 B2
(45) Date of Patent: Jun. 29, 2010

(54) DISPLAY, ARRAY SUBSTRATE, AND METHOD OF DRIVING DISPLAY

(75) Inventors: Yoshiro Aoki, Kitamoto (JP); Hirondo Nakatogawa, Kumagaya (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1187 days.

(21) Appl. No.: 11/341,484

(22) Filed: Jan. 30, 2006

(65) Prior Publication Data

US 2006/0202919 A1 Sep. 14, 2006

(30) Foreign Application Priority Data

Jan. 31, 2005 (JP) ..... 2005-023791
Mar. 31, 2005 (JP) ..... 2005-104648

(51) Int. Cl.
*G09G 3/30* (2006.01)

(52) U.S. Cl. ..... 345/76; 345/82

(58) Field of Classification Search ..... 345/76, 345/77, 82, 690, 84, 89–92, 204
See application file for complete search history.

(56) References Cited

U.S. PATENT DOCUMENTS 6,373,454 B1 4/2002 Knapp et al.
2003/0214465 A1 * 11/2003 Kimura ..... 345/76
2005/0093788 A1 * 5/2005 Shin ..... 345/76

OTHER PUBLICATIONS

U.S. Appl. No. 11/426,490, filed Jun. 26, 2006, Nakatogawa.

* cited by examiner

*Primary Examiner*—Regina Liang
(74) *Attorney, Agent, or Firm*—Oblon, Spivak, McClelland, Maier & Neustadt, L.L.P.

(57) ABSTRACT

A display includes pixels arrange in a matrix. Each pixel includes a display element, a first drive current control circuit which is supplied with a first video signal and outputs a first drive current to the display element at magnitude corresponding to magnitude of the first video signal, and a second drive current control circuit which is supplied with a second video signal and outputs a second drive current to the display element at magnitude corresponding to magnitude of the second video signal. The display can set a ratio T1/T2 larger than 1, wherein T1 represents a time period over which the first drive current control circuit can output the first drive current to the display element, and T2 represents a time period over which the second drive current control circuit can output the second drive current to the display element.

9 Claims, 10 Drawing Sheets

DISPLAY, ARRAY SUBSTRATE, AND METHOD OF DRIVING DISPLAY

CROSS-REFERENCE TO RELATED APPLICATIONS

This application is based upon and claims the benefit of priority from prior Japanese Patent Applications No. 2005-023791, filed Jan. 31, 2005; and No. 2005-104648, filed Mar. 31, 2005, the entire contents of both of which are incorporated herein by reference.

BACKGROUND OF THE INVENTION

1. Field of the Invention

The present invention relates to a display, an array substrate, and a method of driving a display.

2. Description of the Related Art

On a display such as organic electroluminescent (EL) display that controls optical characteristics of each display element by a drive current passed therethrough, image quality deterioration such as luminance unevenness occurs if magnitudes of the drive currents vary. Therefore, when an active matrix driving method is employed in this display, the pixels must be almost the same in characteristics of a drive control element for controlling the magnitude of the drive current. In this display, however, the drive control elements are normally formed on an insulator such as glass substrate, so the characteristics of them easily vary.

U.S. Pat. No. 6,373,454 describes an organic EL display employing a current mirror circuit in a pixel circuit.

This pixel includes an n-channel field-effect transistor as the drive control element, organic EL element, and capacitor. The source of the n-channel field-effect transistor is connected to a power supply line at a lower electric potential, and the capacitor is connected between the gate of the n-channel field-effect transistor and the power supply line. The anode of the organic EL element is connected to a power supply line at a higher electric potential.

The pixel circuit is driven by the method described below.

First, the drain of the n-channel field-effect transistor is connected to its gate. A current $I_{sig}$ at magnitude corresponding to a video signal is made to flow between the drain and source of the n-channel field-effect transistor. This operation sets the voltage between electrodes of the capacitor, equal to a gate-to-source voltage necessary for the n-channel field-effect transistor to pass the current $I_{sig}$ through its channel.

Then, the gate of the n-channel field-effect transistor is disconnected from its drain, and the voltage between the electrodes of the capacitor is maintained. The drain of the n-channel field-effect transistor is subsequently connected to the cathode of the organic EL element. This allows a drive current to flow through the organic EL element at magnitude almost equal to that of the current $I_{sig}$. The organic EL element emits light at a luminance corresponding to the magnitude of the drive current.

As described above, when the above configuration is employed in each pixel circuit, it is possible to make the drive current flow between the drain and source of the n-channel field-effect transistor during a retention period following a write period at magnitude almost equal to that of the current $I_{sig}$ supplied as a video signal during the write period. Therefore, the influence of not only the threshold value $V_{th}$ but also the mobility, dimensions, and the like of the n-channel field-effect transistor on the drive current can be eliminated.

However, it is difficult for the above display to make the drive current sufficiently small. If the drive current cannot be set sufficiently small in, for example, an organic EL display, each gray level within a low gray level range is displayed at a luminance higher than that to be displayed.

BRIEF SUMMARY OF THE INVENTION

According to a first aspect of the present invention, there is provided a display comprising pixels arranged in a matrix, each of the pixels comprising a display element, a first drive current control circuit which is supplied with a first video signal and outputs a first drive current to the display element at magnitude corresponding magnitude of the first video signal, and a second drive current control circuit which is supplied with a second video signal and outputs a second drive current to the display element at magnitude corresponding to magnitude of the second video signal, wherein the display is configured such that a ratio T1/T2 can be set to be larger than 1, where T1 represents a time period over which the first drive current control circuit can outputs the first drive current to the display element, and T2 represents a time period over which the second drive current control circuit can outputs the second drive current to the display element.

According to a second aspect of the present invention, there is provided an array substrate comprising pixel circuits arranged in a matrix, each of the pixel circuits comprising a first drive current control circuit which is supplied with a first video signal and outputs a first drive current to a display element at magnitude corresponding magnitude of the first video signal, and a second drive current control circuit which is supplied with a second video signal and outputs a second drive current to the display element at magnitude corresponding to magnitude of the second video signal, wherein the array substrate is configured such that a ratio T1/T2 can be set to be larger than 1, where T1 represents a time period over which the first drive current control circuit can outputs the first drive current to the display element, and T2 represents a time period over which the second drive current control circuit can outputs the second drive current to the display element.

According to a third aspect of the present invention, there is provided a method of driving the display according to the first aspect, comprising setting the ratio T1/T2 larger than 1.

DETAILED DESCRIPTION OF THE INVENTION

Figure 1:
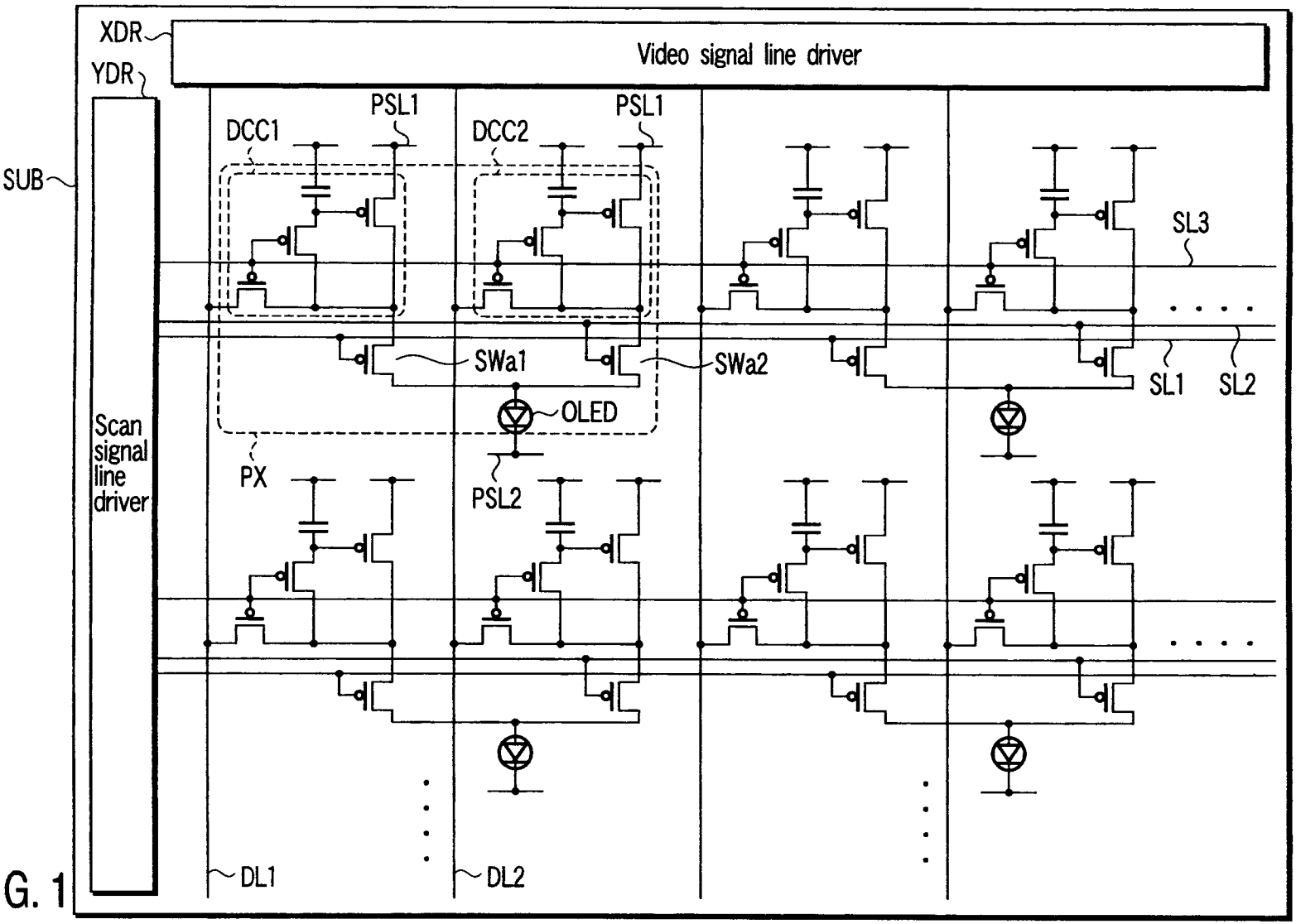
FIG. 1 is a plan view schematically showing a display according to a first embodiment of the present invention.

Embodiments of the present invention will be described below in detail with reference to the drawings. In the drawings, the same reference symbol denotes components having the same or similar functions and duplicate descriptions will be omitted.

Figure 2:
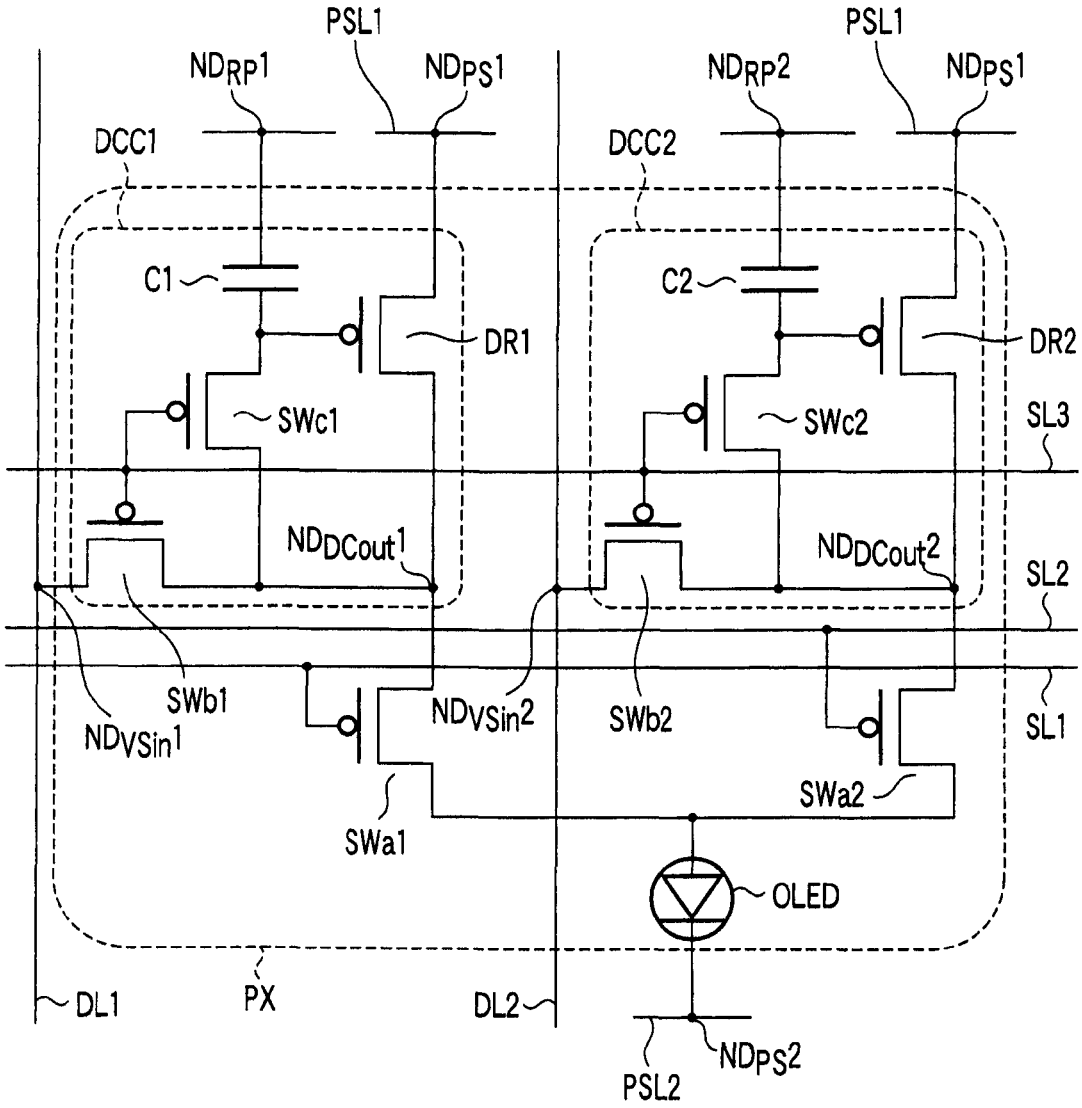
FIG. 2 is an equivalent circuit diagram showing a pixel of the display shown in FIG. 1.

FIG. 1 is a plan view schematically showing a display according to the first embodiment of the present invention. FIG. 2 is an equivalent circuit diagram showing a pixel of the display shown in FIG. 1.

The display is an active matrix display, for example, an active matrix organic EL display, and includes a plurality of pixels PX. The pixels PX are arranged in a matrix on an insulating substrate SUB.

A scan signal line driver YDR and video signal line driver XDR are further arranged on the substrate SUB.

On the substrate SUB, scan signal lines SL1 to SL3 connected to the scan signal line driver YDR and extending in a direction along rows of the pixels PX are arranged in a direction along columns of the pixels PX. The scan signal line driver YDR supplies first to third scan signals as voltage signals to the scan signal lines SL1 to SL3, respectively.

Further, on the substrate SUB, video signal lines DL1 and DL2 connected to the video signal line driver XDR and extending in the direction along columns of the pixels PX are arranged in the direction along rows of the pixels PX. The video signal line driver XDR supplies first and second video signals as current signals to the video signal lines DL1 and DL2, respectively.

In addition, on the substrate SUB, first power supply lines PSL1 and second power supply lines PSL2 are arranged.

Each pixel PX includes a display element OLED, first drive current control circuit DCC1, second drive current control circuit DCC2, first output control switch SWa1, and a second output control switch SWa2. The first drive current control circuit DCC1, second drive current control circuit DCC2, first output control switch SWa1, and second output control switch SWa2 form a pixel circuit.

The first drive current control circuit DCC1, first output control switch SWa1, and display element OLED are connected in series between a first power supply terminal PSL1 and second power supply terminal PSL2 in this order.

A node $ND_{ps}$1 on the first power supply line PSL1 and a node $ND_{ps}$2 on the second power supply line PSL2 correspond to first and second power supply terminals as constant-potential terminals, respectively. As an example, the first power supply terminal $ND_{ps}$1 is a power supply terminal at a higher potential, and the second power supply terminal $ND_{ps}$2 is a power supply terminal at a lower potential.

Nodes $ND_{DCout}$1 and $ND_{DCout}$2 correspond to a first drive current output terminal of the first drive current control circuit DCC1 and a second drive current output terminal of the second drive current control circuit DCC2, respectively. Nodes $ND_{VSin}$1 and $ND_{VSin}$2 correspond to a first video signal input terminal of the first drive current control circuit DCC1 and a second video signal input terminal of the second drive current control circuit DCC2, respectively.

Nodes $ND_{RP}$1 and $ND_{RP}$2 correspond to first and second reference potential terminals, respectively. The reference potential terminals $ND_{RP}$1 and $ND_{RP}$2 are, for example, constant-potential terminals. In this case, the reference potential terminals $ND_{RP}$1 and $ND_{RP}$2 may be nodes on the first power supply line PSL1 or be electrically insulated from the first power supply line PSL1.

The display element OLED includes anode and cathode facing each other, and an active layer whose optical characteristics changes in accordance with magnitude of current flowing therebetween. As an example, the display element OLED is an organic EL element including an emitting layer as the active layer. Further, as an example, the cathode is connected to the second power supply line PSL2. As the display element OLED, a light-emitting element such as inorganic EL element and light-emitting diode may be used.

The first output control switch SWa1 is connected between the first drive current output terminal $ND_{DCout}$1 and the display element OLED. A switching operation of the first output control switch SWa1 is controlled by a first scan signal supplied from the scan signal line driver YDR via the first scan signal line SL1. As an example, the first output control switch SWa1 is a p-channel thin-film transistor whose source, drain, and gate are connected to the first drive current output terminal $ND_{DCout}$1, the anode of the display element OLED, and the first scan signal line SL1, respectively.

The second output control switch SWa2 is connected between the second drive current output terminal $ND_{DCout}$2 and the display element OLED. A switching operation of the second output control switch SWa2 is controlled by a second scan signal supplied from the scan signal line driver YDR via the second scan signal line SL2. As an example, the second output control switch SWa2 is a p-channel thin-film transistor whose source, drain, and gate are connected to the second drive current output terminal $ND_{DCout}$2, the anode of the display element OLED, and the second scan signal line SL2, respectively.

The first drive current control circuit DCC1 includes a first drive control element DR1, first video signal supply control switch SWb1, first diode-connecting switch SWc1, and first capacitor C1.

The first drive control element DR1 includes a field-effect transistor. As an example, the first drive control element DR1 is a p-channel thin-film transistor whose source and drain are connected to the first power supply terminal $ND_{PS}$1 and first drive current output terminal $ND_{DCout}$1, respectively.

The first video signal supply control switch SWb1 is connected between the first video signal input terminal $ND_{VSin}$1 and first drive current output terminal $ND_{DCout}$1. A switching operation of the first video signal supply control switch SWb1 is controlled by a third scan signal supplied from the scan signal line driver YDR via the third scan signal line SL3. As an example, the first video signal supply control switch SWb1 is a p-channel thin-film transistor whose source, drain, and gate are connected to the first drive current output terminal $ND_{DCout}$1, first video signal input terminal $ND_{VSin}$1, and third scan signal line SL3, respectively.

The first diode-connecting switch SWc1 is connected between the drain and gate of the first drive control element DR1. A switching operation of the first diode-connecting switch SWc1 is controlled by the third scan signal supplied from the scan signal line driver YDR via the third scan signal line SL3, or controlled by a fourth scan signal supplied from the scan signal line driver YDR via a fourth scan signal line (not shown). As an example, the first diode-connecting switch SWc1 is a p-channel thin-film transistor whose source, drain, and gate are connected to the first drive current output terminal $ND_{DCout}$1, the gate of the first drive control element DR1, and the third scan signal line SL3.

The first video signal supply control switch SWb1 may be connected between the first video signal input terminal $ND_{VSin}$1 and the gate of the first drive control element DR1. Alternatively, the first diode-connecting switch SWc1 may be connected between the gate of the first drive control element DR1 and the first video signal input terminal $ND_{VSin}$1.

The first capacitor C1 is connected between the gate of the first drive control element DR1 and the first reference potential terminal $ND_{RP}1$. In this embodiment, the first reference potential terminal $ND_{RP}1$ is a constant-potential terminal.

The second drive current control circuit DCC2 includes a second drive control element DR2, second video signal supply control switch SWb2, second diode-connecting switch SWc21 and second capacitor C2.

The second drive control element DR2 includes a field-effect transistor. As an example, the second drive control element DR2 is a p-channel thin-film transistor whose source and drain are connected to the first power supply terminal $ND_{PS}1$ and second drive current output terminal $ND_{DCout}2$, respectively.

The second video signal supply control switch SWb2 is connected between the second video signal input terminal $ND_{VSin}2$ and second drive current output terminal $ND_{DCout}2$. A switching operation of the second video signal supply control switch SWb2 is controlled by the third scan signal supplied from the scan signal line driver YDR via the third scan signal line SL3. As an example, the second video signal supply control switch SWb2 is a p-channel thin-film transistor whose source, drain, and gate are connected to the second drive current output terminal $ND_{DCout}2$, second video signal input terminal $ND_{VSin}2$, and third scan signal line SL3, respectively.

The second diode-connecting switch SWc2 is connected between the drain and gate of the second drive control element DR2. A switching operation of the second diode-connecting switch SWc2 is controlled by the third scan signal supplied from the scan signal line driver YDR via the third scan signal line SL3, or controlled by the fourth scan signal supplied from the scan signal line driver YDR via the fourth scan signal line (not shown). As an example, the second diode-connecting switch SWc2 is a p-channel thin-film transistor whose source, drain, and gate are connected to the second drive current output terminal $ND_{DCout}2$, the gate of the second drive control element DR2, and the third scan signal line SL3.

The second video signal supply control switch SWb2 may be connected between the second video signal input terminal $ND_{VSin}2$ and the gate of the second drive control element DR2. Alternatively, the second diode-connecting switch SWc2 may be connected between the gate of the second drive control element DR2 and the second video signal input terminal $ND_{VSin}2$.

The second capacitor C2 is connected between the gate of the second drive control element DR2 and the second reference potential terminal $ND_{RP}2$. In this embodiment, the second reference potential terminal $ND_{RP}2$ is a constant-potential terminal.

Figure 3:
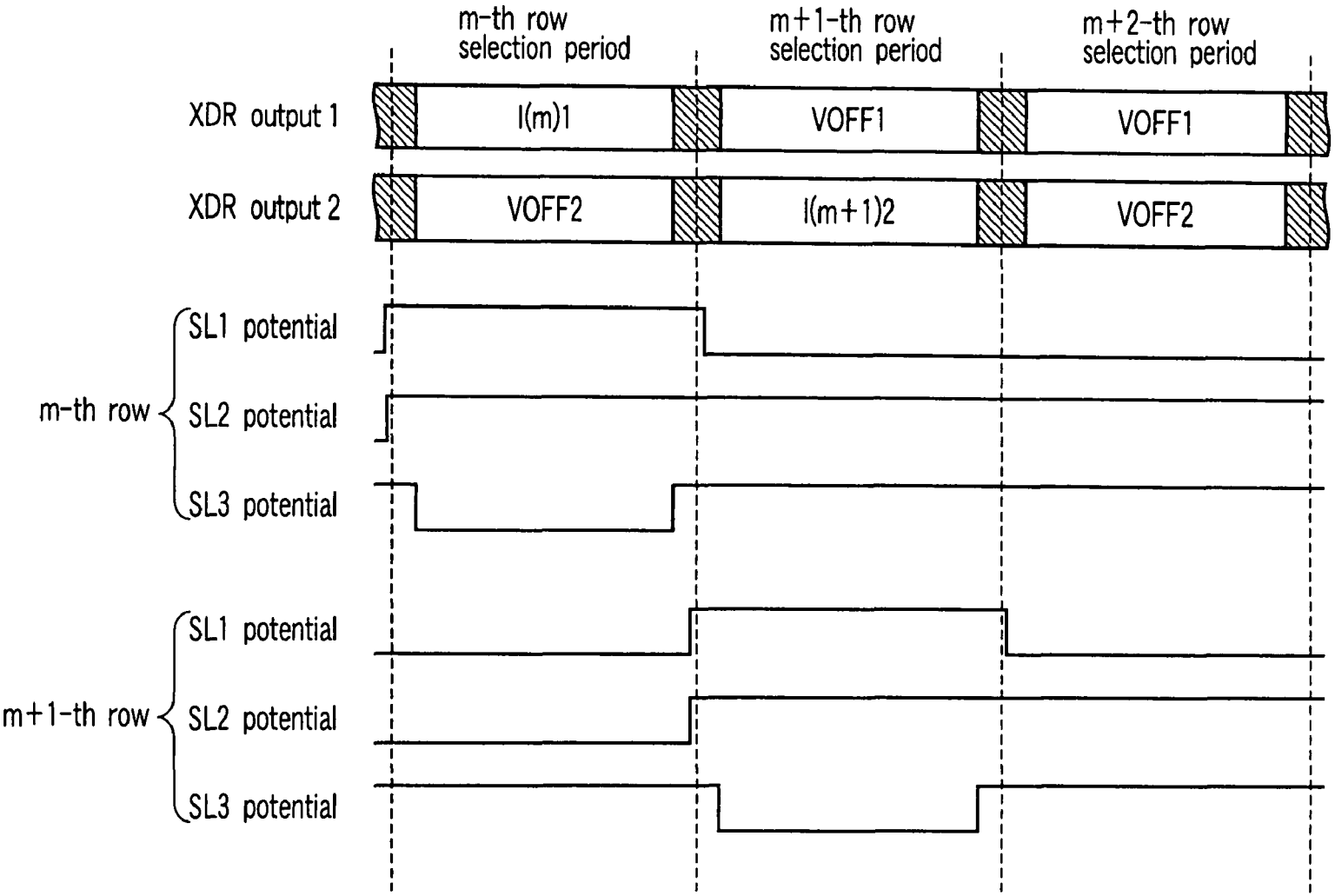
FIG. 3 is a timing chart schematically showing an example of a method of driving the display shown in FIG. 1.

FIG. 3 is a timing chart schematically showing an example of a method of driving the display shown in FIG. 1. FIG. 3 shows an example in which a gray level within a high gray level range is displayed on a pixel PX in an m-th row, and a gray level within a low gray level range is displayed on pixels PX in an m+1-th row and m+2-th row.

In FIG. 3, the abscissa denotes time, while the ordinate denotes potential. "XDR output 1" and "XDR output 2" show signals that the video signal line driver XDR outputs to the first video signal line DL1 and second video signal line DL2, respectively. The waveforms indicated as "SL1 potential" to "SL3 potential" show potentials of the scan signal lines SL1 to SL3, respectively. Further, in FIG. 3, "I(m+k)1" represents magnitude of current or current that flows during an "m+k-th row selection period" over which a pixel PX in an "m+k-th row" is selected, through the video signal line DL1 to which the above pixel PX is connected. "I(m+k)2" represents magnitude of current or current that flows during an "m+k-th row selection period" over which a pixel PX in an "m+k-th row" is selected, through the video signal line DL2 to which the above pixel PX is connected.

As an example, it is assumed that each brightness data is represented in 6 bits, and 64 gray levels are displayed. Further, it is assumed that the brightness data corresponding to the minimum gray level and the brightness data corresponding to the maximum gray level are represented as "000000" and "111111", respectively, the gray level range corresponding to the brightness data "000000" to "abcdef" is the low gray level range, and the gray level range corresponding to other brightness data is the high gray level range.

For example, when a gray level within the high gray level range is to be displayed on a pixel PX in the m-th row, during a period over which the pixel PX in the m-th row is selected, that is, an m-th row selection period, the scan signal driver YDR outputs a first scan signal for opening the first output control switch SWa1 to the first scan signal line SL1. At the same time, the scan signal line driver YDR outputs a second scan signal for opening the second output control switch SWa2 to the second scan signal line SL2. When a gray level within the high gray level range is to be displayed on a pixel PX in the m-th row, the following first write operation is executed during a write period over which the first output control switch SWa1 is open.

That is, the scan signal line driver YDR outputs a third scan signal for closing the video signal supply control switches SWb1 and SWb2 and diode-connecting switches SWc1 and SWc2 to the third scan signal line SL3. In this state, the video signal line driver XDR supplies a first video signal to the selected pixel PX via the first video signal line DL1. At the same time, the video signal line driver XDR supplies a second video signal to the selected pixel PX via the second video signal line DL2.

For example, the video signal line driver XDR makes a first current I(m)1 flow from the first power supply terminal $ND_{PS}1$ to the first video signal line DL1, and outputs a voltage signal $V_{OFF}2$ to the second video signal line DL2. In this case, magnitude of the first current I(m)1 is set at a value L-times the brightness data represented in decimal system (L>0). The voltage signal $V_{OFF}2$ is set at a potential almost equal to or higher than that of the first power supply terminal $ND_{PS}1$.

The first write operation sets the voltage $V_{gs}(m)1$ between the gate of the first drive control element DR1 and the first power supply terminal $ND_{PS}1$ at a negative value at which the current I(m)1 flows from the first power supply terminal $ND_{PS}1$ to the first drive current output terminal $ND_{DCout}1$. The first operation also sets the voltage $V_{gs}(m)2$ between the gate of the second drive control element DR2 and the first power supply terminal $ND_{PS}1$ at a value sufficiently higher than the threshold voltage of the second drive control element DR2.

Then, the scan signal line driver YDR outputs a third scan signal for opening the video signal supply control switches SWb1 and SWb2 and diode-connecting switches SWc1 SWc2 to the third scan signal line SL3. During a period over which the video signal supply control switches SWb1 and SWb2 and diode-connecting switches SWc1 and SWc2 are open, the capacitors C1 and C2 maintain the gate-to-source voltage $V_{gs}(m)1$ of the first drive control element DR1 and the gate-to-source voltage $V_{gs}(m)2$ of the second drive control element DR2 almost constant, respectively.

Subsequently, the scan signal line driver YDR outputs a first scan signal for closing the first output control switch SWa1 to the first scan signal line SL1. Closing the first output control switch SWa1 terminates the write period.

During a display period following the write period, the time period T2 over which the second output control switch SWa2 is closed is set to be shorter than the time period T1 over which the first output control switch SWa1 is closed. As an example, the second output control switch SWa2 is kept open until a certain time period has elapsed from closing the first output control switch SWa1, and closed at a certain point in time before the first output control switch SWa1 is opened again. Note that a ratio T1/T2 of the time period T1 with respect to the time period T2 is set at N (N>1).

During a period over which the first output control switch SWa1 is closed and the second output control switch SWa2 is open, the first drive current control circuit DCC1 outputs a first drive current to the display element OLED at magnitude almost equal to that of the current I(m)1. On the other hand, the second drive current control circuit DCC2 does not output a second drive current to the display element OLED. Consequently, a drive current flows through the display element OLED at magnitude almost equal to that of the current I(m)1.

During a period over which the first output control switch. SWa1 and the second output control switch SWa2 are closed, the first drive current control circuit DCC1 outputs the first drive current to the display element OLED at magnitude almost equal to that of the current I(m)1. Since the gate-to-source voltage $V_{gs}$(m)2 of the second drive control element DR2 is set at a value sufficiently higher than its threshold voltage $V_{th}$2, magnitude of the second drive current that the second drive current control circuit DCC2 outputs to the display element OLED during this period is zero. Consequently, during the time period over which the first output control switch SWa1 and the second output control switch SWa2 are closed, the drive current flows through the display element at magnitude almost equal to that of the current I(m)1.

Thus, during the whole display period, the drive current $I_{drv}$(m) flows through the display element OLED at magnitude almost equal to that of the current I(m)1. Therefore, during the whole display period, the display element OLED emits light at a luminance corresponding to the magnitude of the drive current $I_{drv}$(m).

The write period for the pixel PX in the m+1-th row starts after finishing the write operation on the pixel PX in the m-th row and before closing the second output control switch SWa2. That is, the write period for the pixel in the m+1-th row starts after the scan signal line driver YDR outputs third scan signal for opening the video signal supply control switches SWb1 and SWb2 and diode-connecting switches SWc1ans SWc2 to the third scan signal line SL3 on the m-th row and before the scan signal line driver YDR outputs the second scan signal for closing the second output control switch SWa2 to the second scan signal line SL2 on the m-th row.

During the write period for the pixel in the m+1-th row, the can signal line driver YDR outputs the first scan signal for opening the first output control switch SWa1 to the first scan signal line SL1. At the same time, the scan signal line driver YDR outputs the second scan signal for opening the second output control switch SWa2 to the second scan signal line SL2. When a gray level within the gray level range corresponding to the brightness data from "000001" to "abcdef" is to be displayed on the pixel in the m+1-th row, the following second write operation is executed during the write period over which the first output control switch SWa1 is open.

The scan signal line driver YDR outputs the third scan signal for closing the video signal supply control switches SW1 and SWb2 and diode-connecting switches SWc1 and SWc2 to the third scan signal line SL3. In this state, the video signal line driver XDR outputs a first video signal to the selected pixel PX via the first video signal line DL1. At the same time, the video signal line driver XDR outputs a second video signal to the selected pixel PX via the second video signal line DL2.

Specifically, the video signal line driver XDR outputs a voltage signal $V_{OFF}$1 to the first video signal line DL1. Then, the video signal line driver XDR makes a second current I(m+1)2 flow from the first power supply terminal $ND_{PS}$1 to the second video signal line DL2. For example, magnitude of the second current I(m+1)2 is set L×M-times the brightness data represented in decimal system (M>1). The voltage signal $V_{OFF}$1 is set almost equal to or higher than the potential of the first power supply terminal $ND_{PS}$1.

The second write operation sets the voltage $V_{gs}$(m+1)1 between the gate of the first drive control element DR1 and the first power supply terminal $ND_{PS}$1 at a value sufficiently higher than the threshold voltage $V_{th}$1 of the first drive control element DR1. On the other hand, the voltage $V_{gs}$(m+1)2 between the gate of the second drive control element DR2 and the first power supply terminal $ND_{PS}$1 is set at a negative value that allows the current I(m+1)2 to flow from the first power supply terminal $ND_{PS}$1 to the second drive current output terminal $ND_{DCout}$2.

Then, the scan signal line driver YDR outputs the third scan signal for opening the video signal supply control switches SWb1 and SWb2 and diode-connecting switches SWc1 and SWc2 to the third scan signal line SL3. During a period over which the video signal supply control switches SWb1 and SW2 and diode-connecting switches SWc1 and SWc2 are open, the capacitors C1 and C2 maintain the gate-to-source voltage $V_{gs}$(m+1)1 of the first drive control element DR1 and the gate-to-source voltage $V_{gs}$(m+1)2 of the second drive control element DR2 almost constant, respectively.

Subsequently, the scan signal line driver YDR outputs the first scan signal for closing the first output control switch SWa1 to the first scan signal line SL1. Closing the first output control switch SWa1 terminates the write period.

As described above, during the display period following the write period, the time period T2 over which the second output control switch SWa2 is closed is set to be shorter than the time period T1 over which the first output control switch SWa1 is closed. In this embodiment, the first output control switch SWa1 is kept open until a certain time period has elapsed from losing the first output control switch SWa1, and closed at a certain point in time before the first output control switch SWa1 is opened again.

The gate-to-source voltage $V_{gs}$(m+1)1 of the first drive current control element DR1 is set at a value sufficiently higher than its threshold voltage $V_{th}$1. Therefore, during the period over which the first output control switch SWa1 is closed and the second output control switch SWa2 is open, magnitude of the first drive current that the first drive current control circuit DCC1 outputs to the display element OLED is zero. In this period, the second drive current control circuit DCC2 does not output the second drive current to the display element OLED. Consequently, no drive current flows through the display element OLED.

During the period over which the first output control switch SWa1 and second output control switch SWa2 are closed, the gate-to-source voltage $V_{gs}$(m)1 of the first drive control element DR1 is set sufficiently higher than its threshold voltage $V_{th}$1. Therefore, during this period, magnitude of the first drive current that the first drive current control circuit DCC1 to the display element OLED is zero. On the other hand, the second drive current control circuit DCC2 outputs the second drive current to the display element OLED at magnitude almost equal to that of the current I(m+1)2. Consequently, the drive current $I_{drv}$(m+1) flows through the display element OLED at magnitude almost equal to that of the current I(m+1)2.

Thus, of the display period, only during the period over which the second output control switch SWa2 is closed, the drive current $I_{drv}$(m+1) at magnitude almost equal to that of the current I(m+1)2 flows through the display element OLED. Therefore, of the display period, only during the period over which the second output control switch SWa2 is closed, the display element OLED emits light at a luminance corresponding to the magnitude of the drive current $I_{drv}$(m+1).

Note that when the gray level corresponding to the brightness data "000000" is to be displayed on the pixel PX in the m+2-th row, the third write operation, which is the same as the second write operation except for the following, may be executed instead of the first or second write operation. That is, during the period over which the video signal supply control switches SWb1 and SWb2 and the diode-connecting switches SWc1and SWc2 are closed, the video signal line driver XDR outputs a voltage signal $V_{OFF}$1 to the first video signal line DL1. And, the video signal line driver XDR outputs a voltage signal $V_{OFF}$2 to the second video signal line DL2, instead of making the second current I(m+1)2 flow from the first power supply terminal $ND_{PS}$1 to the second video signal line DL2. According to this, it can be prevented that the drive current flows through the display element OLED.

When the second video signal line DL2 are omitted and each pixel PX does not includes the second drive current control circuit DCC2 and the output control switch SWa2, in order to display a gray level within the low gray level range, the first video signal I(m+k)1 supplied to the first drive current control circuit DCC1 must be small. When the first video signal I(m+k)1 is small, an influence of parasitic capacitance of the video signal line DL1 is large. Therefore, it is difficult to precisely set the gate-to-source voltage of the first drive control element DR1 included in the pixel PX in the m+k-th row at a value corresponding to the first video signal I(m+k)1 within the write period for this pixel PX.

For example, if the magnitude of the first video signal I(m+k)1 is set L×M-times the brightness data over the whole gray level range (L>0, M>1), the above problem is less prone to occur as compared with the case where the magnitude of the first video signal I(m+k)l is set L-times the brightness data. However, when the factor M is set large in this method in order to achieve a sufficient effect, the video signal line driver XDR must output the first video signal I(m+k)l to the first video signal line DL1 at extremely large magnitude when a gray level within the high gray level range is to be displayed. That is, the load on the video signal line driver XDR is heavy. Further, when gray level within the high gray level range is to be displayed by this driving method, the drive current $I_{drv}$(m+k) at extremely large magnitude must be made to flow through the display element OLED. The display element OLED such as organic EL element is easy to deteriorate when the magnitude of the drive current $I_{drv}$(m+k) is large. Therefore, the driving method in which the magnitude of the first video signal I(m+k)1 is multiplied by M for each gray level over the whole gray level range is impractical.

By contrast, according to the driving method described with reference to FIG. 3, when a gray level within the high gray level range is to be displayed, the first drive current control circuit DCC1 is supplied with the first video signal I(m+k)1 at magnitude L-times the brightness data. Further, the second drive current control circuit DCC2 is supplied with the voltage signal $V_{OFF}$2. That is, when a gray level within the high gray level range is to be displayed, an output of the second drive current control circuit DCC2 is set at zero, and the magnitude of the drive current $I_{drv}$(m+k) is controlled only by the first drive current control circuit DCC1.

When a gray level within the high gray level range is to be displayed, the first video signal I(m+k)1 is sufficiently large. Therefore, the gate-to-source voltage $V_{gs}$(m+k)1 of the first drive control element DR1 can be precisely set at a value corresponding to the first video signal I(m+k)1. Further, since the voltage signal $V_{OFF}$2 is supplied to the second drive current control circuit DCC2, an output of the second drive current control circuit DCC2 can be set at zero with reliability. Therefore, according to the driving method shown in FIG. 3, when a gray level within the high gray level range is to be displayed, it is possible to make the magnitude of the drive current $I_{drv}$(m+k), which is to be passed through the display element OLED, precisely correspond with a value L-times the brightness data. Thus, according to the driving method shown in FIG. 3, a gray level within the high gray level range can be displayed with high reproducibility.

Further, according to the driving method shown in FIG. 3, when a gray level within the low gray level range is to be displayed, the voltage signal $V_{OFF}$1 is supplied to the first drive current control circuit DCC1. That is, when a gray level within the low gray level range is to be displayed, an output of the first drive current control circuit DCC1 is set at zero, and the magnitude of the drive current $I_{drv}$(m+k) is controlled only by the second drive current control circuit DCC2. In addition, the magnitude of the second video signal I(m+k)2 to be supplied to the second drive current control circuit DCC2 is set at a value L×M-times the brightness data (M>1), and the time period T2 over which the second output control switch SWa2 is closed is 1/N-times the time period T1 over which the first output control switch SWa1 is closed (N>1). For example, the factor M is about 5, and the factor 1/N is about ⅕.

When the factor M is sufficiently large, the gate-to-source voltage $V_{gs}$(m+k)2 of the second drive control element DR2 can be precisely set at a value corresponding the second video signal I(m+k)2. Since the voltage signal $V_{OFF}$1 is supplied to the first drive current control circuit DCC1, an output of the first drive current control circuit DCC1 can be set at zero with reliability. Therefore, according the driving method shown in FIG. 3, when a gray level within the low gray level range is to be displayed, the magnitude of the drive current passed through the display element OLED can be precisely controlled at a value L×M-times the brightness data.

In addition, since the time period T1 over which the first output control switch SWa1 is closed and the time period T2 over which the second output control switch SWa2 is closed can be precisely controlled, the factor 1/N can also be precisely controlled. Therefore, according to the driving method shown in FIG. 3, a gray level within the low gray level range can be displayed with high reproducibility.

Thus, according to the driving method shown in FIG. 3, all the gray levels can be displayed with high reproducibility.

Further, according to the driving method shown in FIG. 3, the magnitude of the first video signal I(m+k)1 is set at a value L-times the brightness data when a gray level within the high gray level range is to be displayed (L>0), and the magnitude of the second video signal I(m+k)2 is set at a value L×M-times the brightness data only when a gray level only when a gray level within the low gray level range is to be displayed (M>1). Therefore, when a gray level within the high gray level range is to be displayed, a heavy load is not applied onto the video signal line driver XDR. In addition, since a drive current at extremely large magnitude does not flows through the display element OLED, deterioration of the display element OLED is less prone to occur.

Further, according to the driving method shown in FIG. 3, writing the first video signal on the first drive current control circuit DCC1 and writing the second video signal on the second drive current control circuit DCC2 are executed simultaneously. Thus, writing the video signal on each pixel PX can be finished within a shorter time period as compared with the case where writing the first video signal on the first drive current control circuit DCC1 and writing the second video signal on the second drive current control circuit DCC2 are executed sequentially.

The second embodiment of the present invention will be described.

Figure 4:
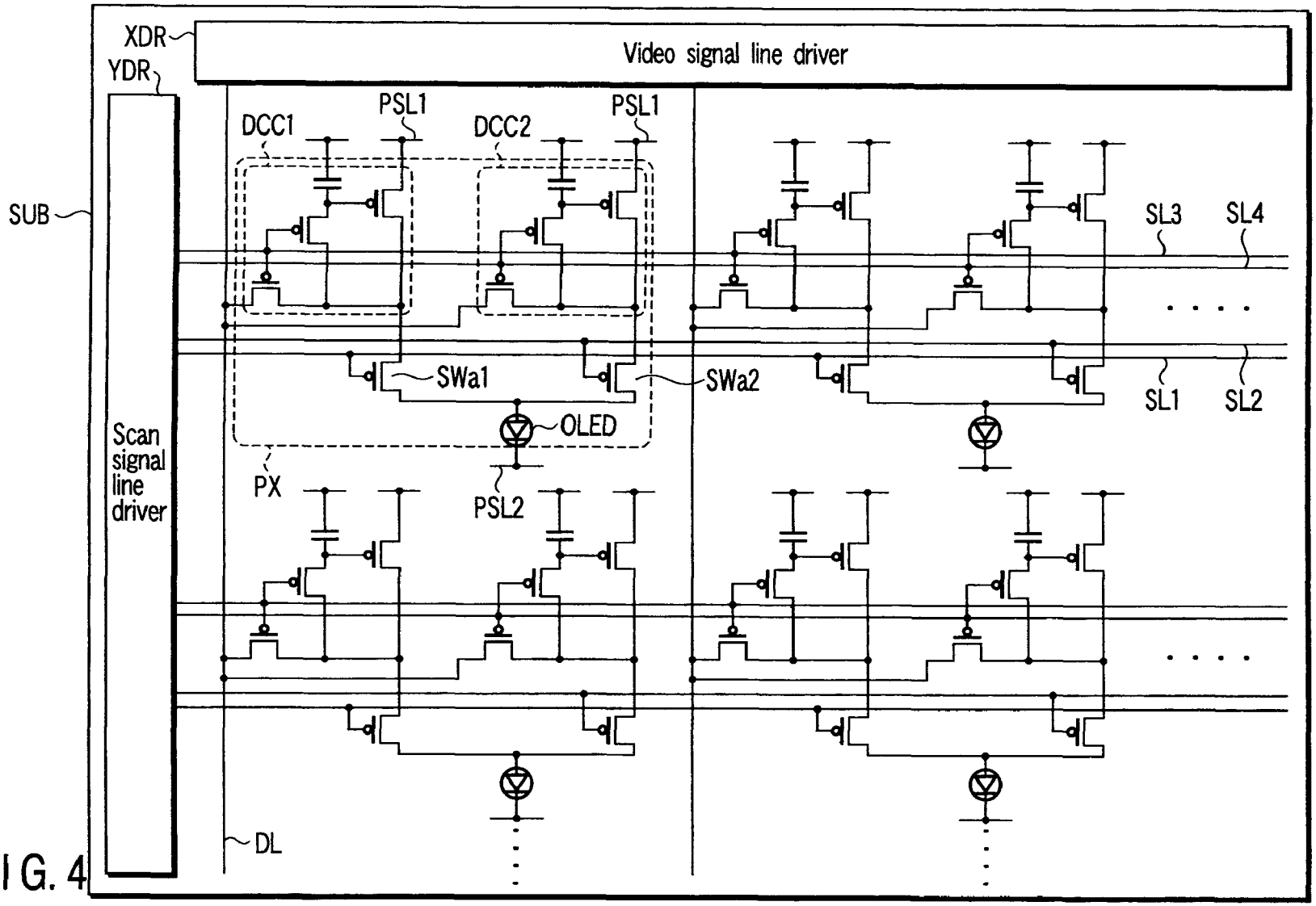
FIG. 4 is a plan view schematically showing a display according to a second embodiment of the present invention.
Figure 5:
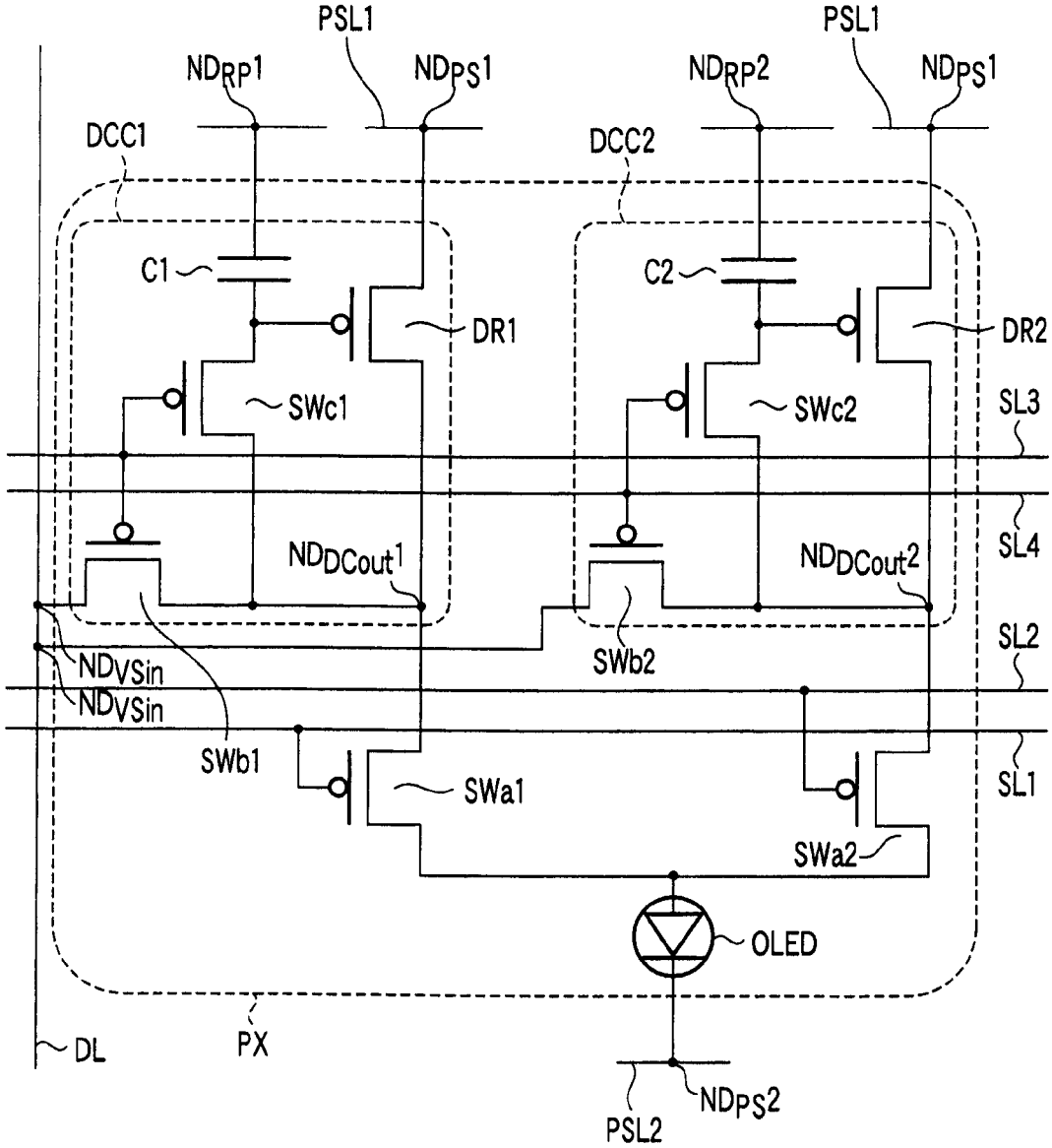
FIG. 5 is an equivalent circuit diagram showing a pixel of the display shown in FIG. 4.

FIG. 4 is a plan view schematically showing a display according to the second embodiment of the present invention. FIG. 5 is an equivalent circuit diagram showing a pixel of the display shown in FIG. 4.

The display is an active matrix display, for example, an active matrix organic EL display, and includes a plurality of pixels PX. The display has the same structure as that of the display described with reference to FIGS. 1 and 2 except that the following configuration is employed.

On the substrate SUB of the display, fourth scan signal lines SL4 extending in the direction along the rows of the pixels PX are further placed in addition to the first scan signal lines SL1, second scan signal lines SL2, and third scan signal lines SL3. The fourth scan signal lines are connected to the scan signal line driver YDR and arranged in the direction along the columns of the pixels PX. The scan signal line driver YDR supplies the fourth scan signal lines SL4 with fourth scan signals as voltage signals.

From the display, the first video signal lines DL1 and second video signal lines DL2 on the insulating substrate SUB are omitted. Instead, on the substrate SUB, video signal lines DL extending the direction along the columns of the pixels PX are placed. The video signal lines are connected to the video signal line driver XDR and arranged in the direction along the rows of the pixels PX. The video signal line driver XDR supplies the video signal lines DL with first and second video signals as current signals.

The video signal supply control switch SWb1 is connected between the video signal input terminal $ND_{VSin}$ on the video signal line DL and the first drive current output terminal $ND_{DCout}$1. A switching operation of the first video signal supply control switch SWb1 is controlled by a third scan signal supplied from the scan signal line driver YDR via the third scan signal line SL3. As an example, the first video signal supply control switch SWb1 is a p-channel thin-film transistor whose source, drain, and gate are connected to the first drive current output terminal $ND_{DCout}$1, video signal input terminal $ND_{VSin}$, and third scan signal line SL3, respectively.

The second video signal supply control switch SWb2 is connected between the video signal input terminal $ND_{VSin}$ and second drive current output terminal $ND_{DCout}$2. A switching operation of the second video signal supply control terminal is controlled by a fourth scan signal supplied from the scan signal line driver YDR via the fourth scan signal line SL4. As an example, the second video signal supply control switch SWb2 is a p-channel thin-film transistor whose source, drain, and gate are connected to the second drive current output terminal $ND_{DCout}$2, video signal input terminal $ND_{VSin}$, and fourth scan signal line SL4.

Figure 6:
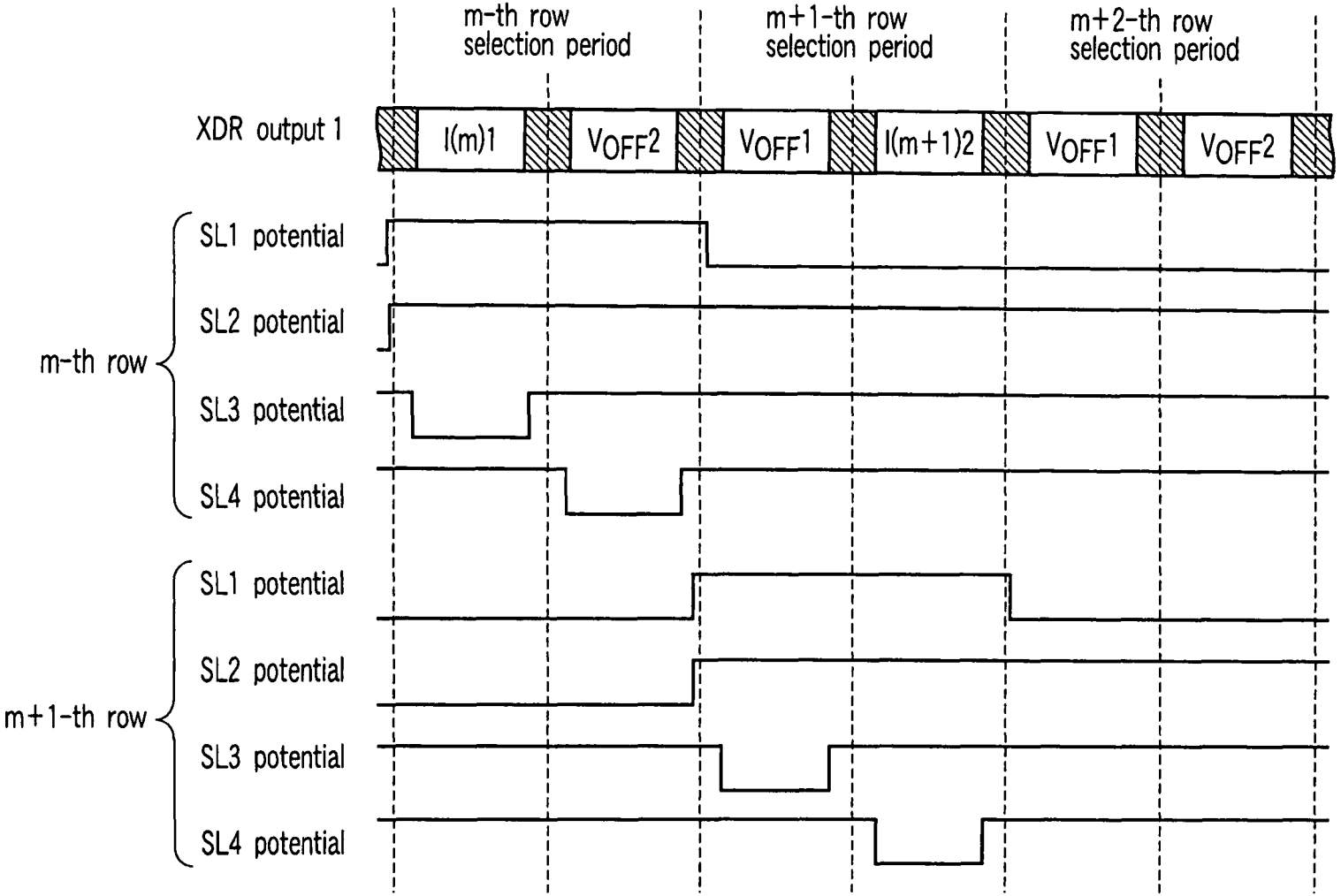
FIG. 6 is a timing chart schematically showing an example of a method of driving the display shown in FIG. 4.

FIG. 6 is a timing chart schematically showing an example of a method of driving the display shown in FIG. 4. FIG. 6 shows an example in which a gray level within a high gray level range is displayed on a pixel PX in the m-th row, and a gray level within a low gray level range is displayed on pixels PX in the m+1-th row and m+2-th row.

In FIG. 6, the abscissa denotes time, while the ordinate denotes potential. "XDR output" shows a signal that the video signal line driver XDR outputs to each video signal line DL. The waveforms indicated as "SL1 potential" to "SL4 potential" show potentials of the scan signal lines SL1 to SL4, respectively. Further, in FIG. 6, "I(m+k)1" and "I(m+k)2" represent magnitudes of currents or currents that sequentially flow during the "m+k-th row selection period" over which a pixel PX in the "m+k-th row" is selected, through the video signal line DL to which the above pixel PX is connected.

As an example, it is assumed that each brightness data is represented in 6 bits, and 64 gray levels are displayed. Further, it is assumed that the brightness data corresponding to the minimum gray level and the brightness data corresponding to the maximum gray level are represented as "000000" and "111111", respectively, the gray level range corresponding to the brightness data "000000" to "abcdef" is the low gray level range, and the gray level range corresponding to other brightness data is the high gray level range.

When a gray level within the high gray level range is to be displayed on a pixel PX in the m-th row, during the period over which the pixel PX in the m-th row is selected, that is, the m-th row selection period, the scan signal driver YDR outputs a first scan signal for opening the first output control switch SWa1 to the first scan signal line SL1. At the same time, the scan signal line driver YDR outputs a second scan signal for opening the second output control switch SWa2 to the second scan signal line SL2. During the write period over which the first output control switch SWa1 is open, the following first and second write operations are executed sequentially.

In the first write operation, the scan signal line driver YDR outputs the third scan signal for closing the first video signal supply control switch SWb1 and first diode-connecting switch SWc1 to the third scan signal line SL3. The second video signal supply control switch SWb2 and the second diode-connecting switch SWc2 are kept open. In this state, the video signal line driver XDR supplies a first video signal to the selected pixel PX via the video signal line DL. That is, the video signal line driver XDR makes a first current I(m)1 flow from the first power supply terminal $ND_{PS}$1 to the first video signal output terminal $ND_{DCout}$1.

The magnitude of the first current I(m)1 is set at the same value as described in the first embodiment. As an example, the magnitude of the first current I(m)1 is set at a value L-times the brightness data in decimal system (L>0).

Then, the scan signal line driver XDR outputs a third scan signal for opening the first video signal supply control switch SWb1 and first diode-connecting switch SWc1 to the third scan signal line SL3. Thus, the first write operation is finished.

After finishing the first write operation, the second write operation is started.

In the second write operation, the scan signal line driver YDR outputs a fourth scan signal for closing the second video signal supply control switch SWb2 and second diode-connecting switch SWc2 to the fourth scan signal line SL4. In this state, the video signal line driver XDR outputs a second video signal to the second drive current control circuit DCC2 of the selected pixel PX via the video signal line DL. That is, the video signal line driver XDR outputs a voltage signal $V_{OFF}$2 to the video signal line DL. As in the first embodiment, the voltage signal $V_{OFF}$2 is set at potential almost equal to or higher than that of the first power supply terminal $ND_{PS}$1.

Then, the scan signal line driver YDR outputs a fourth scan signal for opening the second video signal supply control switch SWb2 and second diode-connecting switch SWc2 to the fourth scan signal line SL4. Thus, the second write operation is finished.

Subsequently, the scan signal line driver YDR outputs a first scan signal for closing the first output control switch SWa1 to the first scan signal line SL1. Closing the first output control switch SWa1 terminates the write period.

As in the first embodiment, during the display period following the write period, the time period T2 over which the second output control switch SWa2 is closed is set to be shorter than the time period T1 over which the first output control switch SWa1 is closed. As an example, the second output control switch SWa2 is kept open until a certain time period has elapsed from closing the first output control switch SWa1, and closed at a certain point in time before the first output control switch SWa1 is opened again.

A drive current $I_{drv}(m)$ at magnitude almost equal to that of the current I(m)1 flows through the display element OLED over the whole display period. Therefore, the display element OLED emits light at a luminance corresponding to the drive current $I_{drv}(m)$ over the whole display period.

The write period for the pixel PX in the m+1-th row starts after finishing the second write operation on the pixel PX in the m-th row and before the second output control switch SWa2 is closed. That is, the write period for the pixel PX in the m+1-th row starts after the scan signal line driver YDR outputs a fourth scan signal for opening the second video signal supply control switch SWb2 and second diode-connecting switch SWc2 to the fourth scan signal line SL4 on the m-th row and before the scan signal line driver YDR outputs a second scan signal for closing the second output control switch SWa2 to the second scan signal line SL2 on the m-th row.

During the write period for the pixel PX in the m+1-th row, the scan signal line driver YDR outputs the first scan signal for opening the first output control switch SWa1 to the first scan signal line SL1. At the same time, the scan signal line driver YDR outputs the second scan signal for opening the second output control switch SWa2 to the second scan signal line SL2. When a gray level within the gray level range corresponding to the brightness data from "000001" to "abcdef" is to be displayed on the pixel in the m+1-th row, the following third and fourth write operations are executed sequentially during the write period over which the first output control switch SWa1 is open.

In the third write operation, the scan signal line driver YDR outputs a third scan signal for closing the first video signal supply control switch SWb1 and the first diode-connecting switch SWc1 to the third scan signal line SL3. The second video signal supply control switch SWb2 and the second diode-connecting switch SWc2 are kept closed. In this state, the video signal line driver XDR outputs a first video signal to the first drive current control circuit DCC1 of the selected pixel PX via the video signal line DL. That is, the video signal line driver XDR outputs a voltage signal $V_{OFF}$1 to the video signal line DL. As described in the first embodiment, the voltage signal $V_{OFF}$1 is set at a potential almost equal to or higher than that of the first power supply terminal $ND_{PS}$1.

Then, the scan signal line driver YDR outputs a third scan signal for opening the first video signal supply control switch SWb1 and the first diode-connecting switch SWc1 to the third scan signal line SL3 to terminate the third write operation.

After finishing the third write operation, the fourth write operation is started.

In the fourth write operation, the scan signal line driver YDR outputs a fourth scan signal for closing the second video signal supply control switch SWb2 and second diode-connecting switch SWc2 to the fourth scan signal line SL4. In this state, the video signal line driver XDR outputs a second video signal to the second drive current control circuit DCC2 of the selected pixel PX via the video signal line DL. That is, the video signal line driver XDR makes a second current I(m+1)2 flow from the first power supply terminal $ND_{PS}$1 to the second video signal output terminal $ND_{DCout}$2.

The magnitude of the second current I(m+1)2 is set as described in the first embodiment. As an example, the magnitude of the second current I(m+1)2 is set L×M-times the brightness data represented in decimal system (L>1, M>1).

Then, the scan signal driver YDR outputs a forth scan signal for opening the second video signal supply control switch SWb2 and the second diode-connecting switch SWc2 to the fourth scan signal SL4 to terminate the fourth write operation.

After finishing the third and fourth write operations, the scan signal line driver YDR a first scan signal for closing the first output control switch SWa1 to the first scan signal line SL1. Closing the first output control switch SWa1 terminates the write operation.

As described above, during the display period following the write period, the time period T2 over which the second output control switch SWa2 is closed is set to be shorter than the time period T1 over which the first output control switch SWa1 is closed. As an example, the second output control switch SWa2 is kept open until a certain time period has elapsed from closing the first output control switch SWa1, and closed at a certain point in time before the first output control switch SWa1 is opened again.

A drive current $I_{drv}(m+1)$ at magnitude almost equal to that of the current I(m+1)2 flows through the display element OLED only in the period over which the second output control switch SWa2 is closed. Therefore, the display element OLED emits light at a luminance corresponding to the drive current $I_{drv}(m)$ only in the period over which the second output control switch SWa2 is closed.

When a gray level corresponding the brightness data "000000" is to be displayed on a pixel in the m+2-th row, the third and second write operations may be executed sequentially during the write period. That is, during the period over which the first video signal supply control switch SWb1 and the first diode-connecting switch SWc1 are closed, the video signal line drive XDR outputs the voltage signal $V_{OFF}$1 to the first video signal line DL1. In addition, the video signal line driver XDR outputs the voltage signal $V_{OFF}$2 to the second video signal line DL2. This prevent a drive current from flowing through the display element OLED in the display period.

As described above, the driving method shown in FIG. 6 is the same as the driving method shown in FIG. 3 except that writing the first video signal on the first drive current control circuit DCC1 and writing the second video signal on the second drive current control circuit DCC2 are executed sequentially. Therefore, according to the present embodiment, all the gray levels can be displayed with high reproducibility, a heavy load does not applied onto the video signal line driver XDR, and deterioration of the display element OLED is less prone to occur.

The display shown in FIG. 4 can employ the following structure in the video signal line driver XDR.

Figure 7:
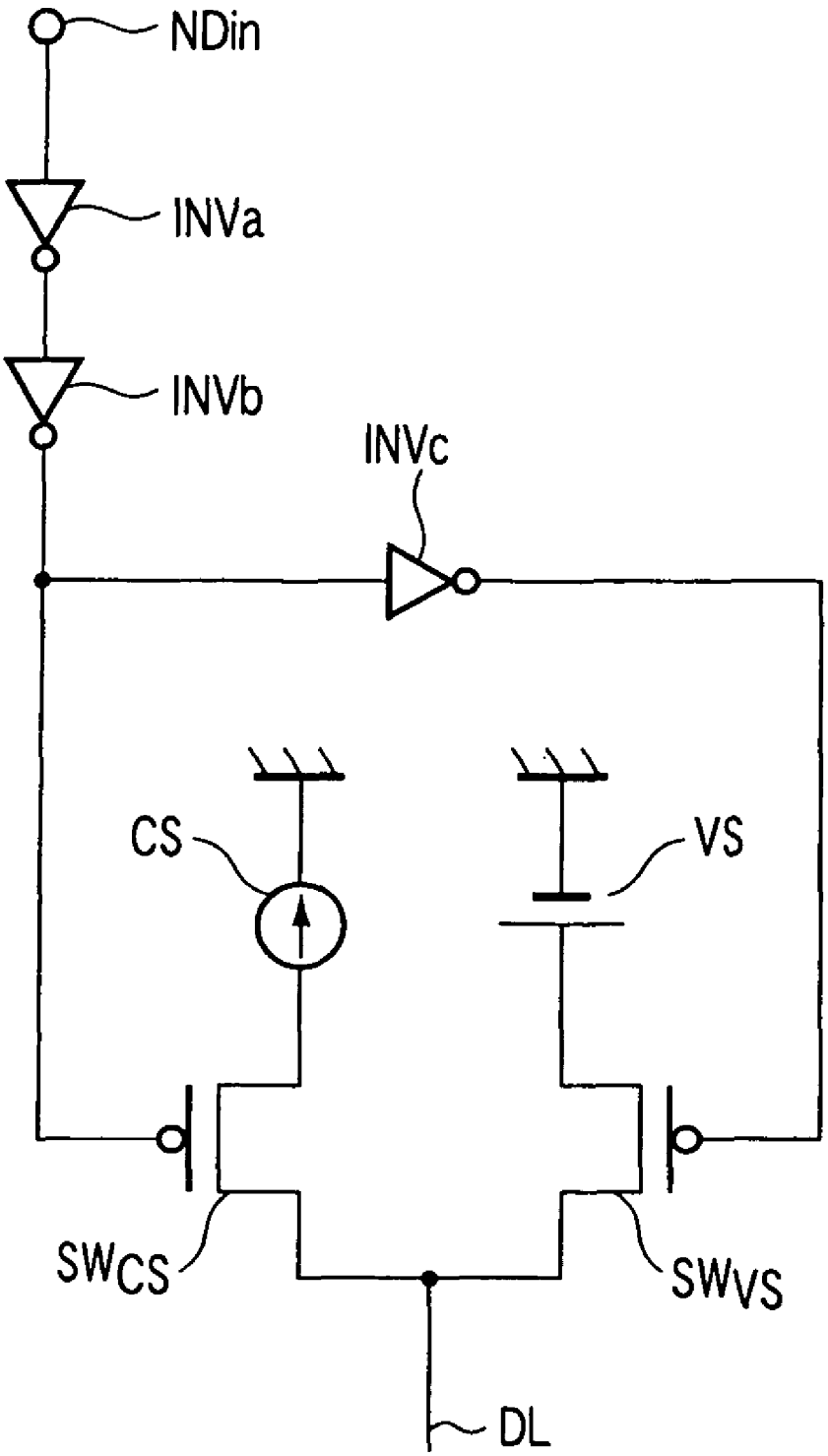
FIG. 7 is an equivalent circuit diagram showing an example of a structure that a video signal line driver of the display shown in FIG. 4 can employ.
Figure 9:
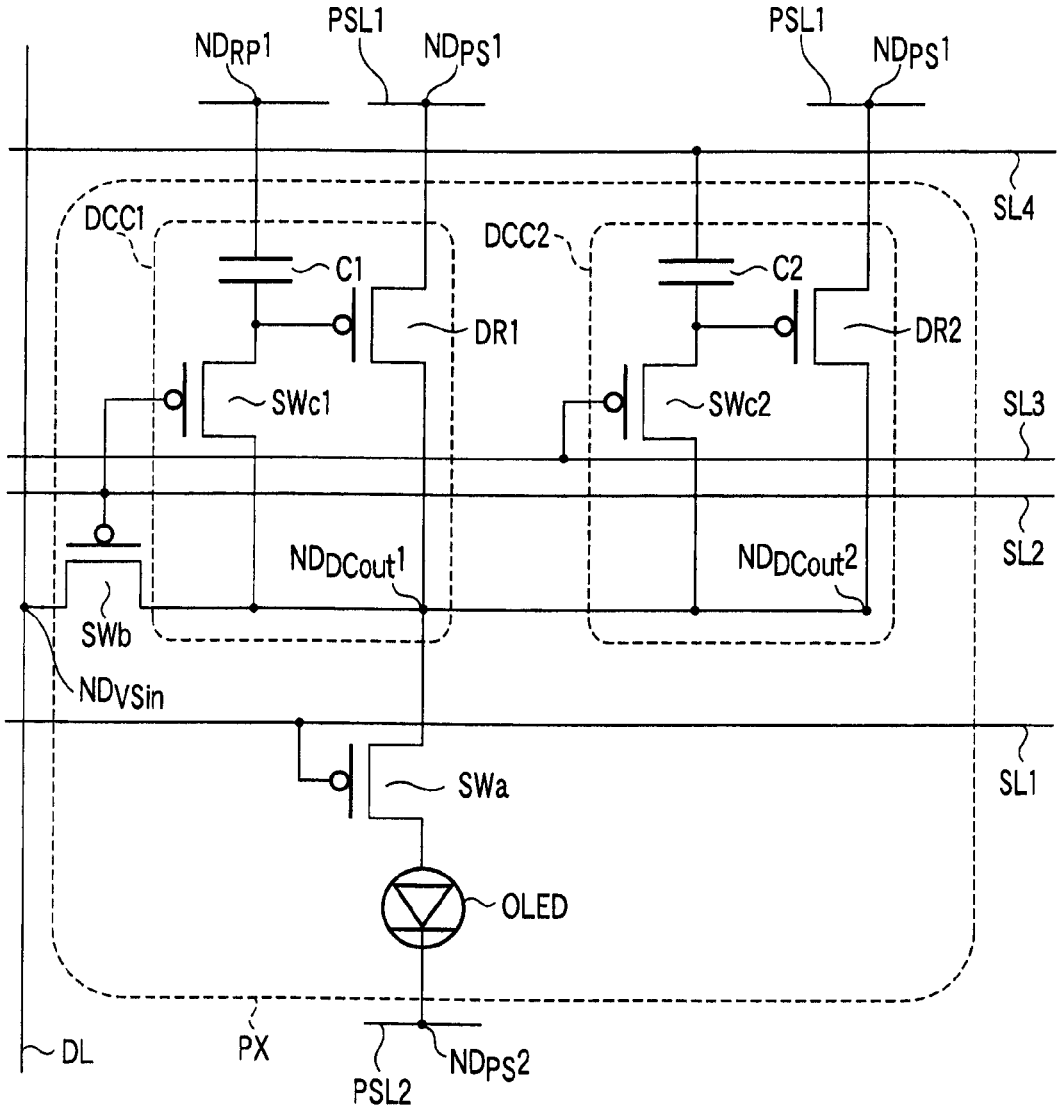
FIG. 9 is an equivalent circuit diagram showing a pixel of the display shown in FIG. 8.

FIG. 7 is an equivalent circuit diagram showing an example of a structure that the display shown in FIG. 9 can employ in the video signal line driver. This circuit includes inverter circuits INVa to INVc, switches SWcs and SWvs, current source CS, and voltage source VS. In the present example, p-channel field-effect transistors are used as the switches SWcs and SWvs.

An input terminal of the inverter circuit INVa is connected to a terminal $ND_{in}$. For example, the terminal $ND_{in}$ is supplied with a voltage signal that is proportional to the brightness data represented in decimal system (a voltage signal corresponding to a low gray level is higher than a voltage signal corresponding to a high gray level). An output terminal of the inverter INVa is connected to the input terminal of the inverter circuit INVa. The inverter circuits INVa and INVb amplify an analog signal input to the terminal $ND_{in}$, and the amplified signal is output from an output terminal of the inverter circuit INVb.

The switch SWcs and current source CS are connected in series between the video signal line DL and a ground wire in this order. The gate of the switch SWcs is connected to the output terminal of the inverter INVb. For example, the current source outputs a current signal that is proportional to the brightness data represented in decimal system.

The switch SWvs and voltage source VS are connected in series between the video signal line DL and ground wire in this order. For example, the voltage source VS outputs the voltage signal $V_{OFF}$1 and/or $V_{OFF}$2.

An output terminal of the inverter INVc is connected to the gate of the switch SWvs, and an input terminal of the inverter INVc is connected to the output terminal of the inverter INVb. The inverter INVc inverts a voltage signal to be supplied to the gate of the gate of the switch SWvs with respect to a voltage to be supplied to the gate of the switch SWcs.

When the signal input to the terminal $ND_{in}$ is a voltage signal corresponding to a gray level within the low gray level range, this circuit makes the switch SWvs open and closes the switch SWcs. That is, it outputs a current signal to the video signal line DL in this case.

When the signal input to the terminal $ND_{in}$ is a voltage signal corresponding to a gray level within the high gray level range, the circuit closes the switch SWvs and makes the switch SWcs open. That is, it outputs a voltage signal to the video signal line in this case.

Note that the circuit shown in FIG. 7 may be used in the display shown in FIG. 1. Specifically, in the video signal line driver XDR of the display shown in FIG. 1, the circuit shown in FIG. 7 may be placed for each pair of the video signal lines DL1 and DL2, and the video signal line DL1 or DL2 may be connected as the video signal line DL to the circuit.

In the first and second embodiments, when the minimum gray level is to be displayed, the video signal line driver XDR outputs the voltage signal $V_{OFF}$1 as the first video signal to the first drive current control circuit DCC1, and outputs the voltage signal $V_{OFF}$2 as the second video signal to the second drive current control circuit DCC2. Instead, when the minimum gray level is to be displayed, the video signal line driver XDR may output the current signal I(m+k)1 as the first video signal to the first drive current control circuit DCC1, and output the current signal I(m+k)2 as the second video signal to the second drive current control circuit DCC2.

In the first and second embodiments, when the maximum gray level is to be displayed, the video signal line driver XDR outputs the voltage signal $V_{OFF}$2 as the second video signal to the second drive current control circuit DCC2. Instead, when the maximum gray level is to be displayed, the video signal line driver XDR may output the current signal I(m+k)2 as the second video signal to the second drive current control circuit DCC2. That is, when the maximum gray level is to be displayed, the second drive current control circuit DCC2 may outputs the second drive current to the display element OLED, in addition to that the first drive current control circuit DCC1 outputs the first drive current to the display element OLED.

The third embodiment of the present invention will be described.

Figure 8:
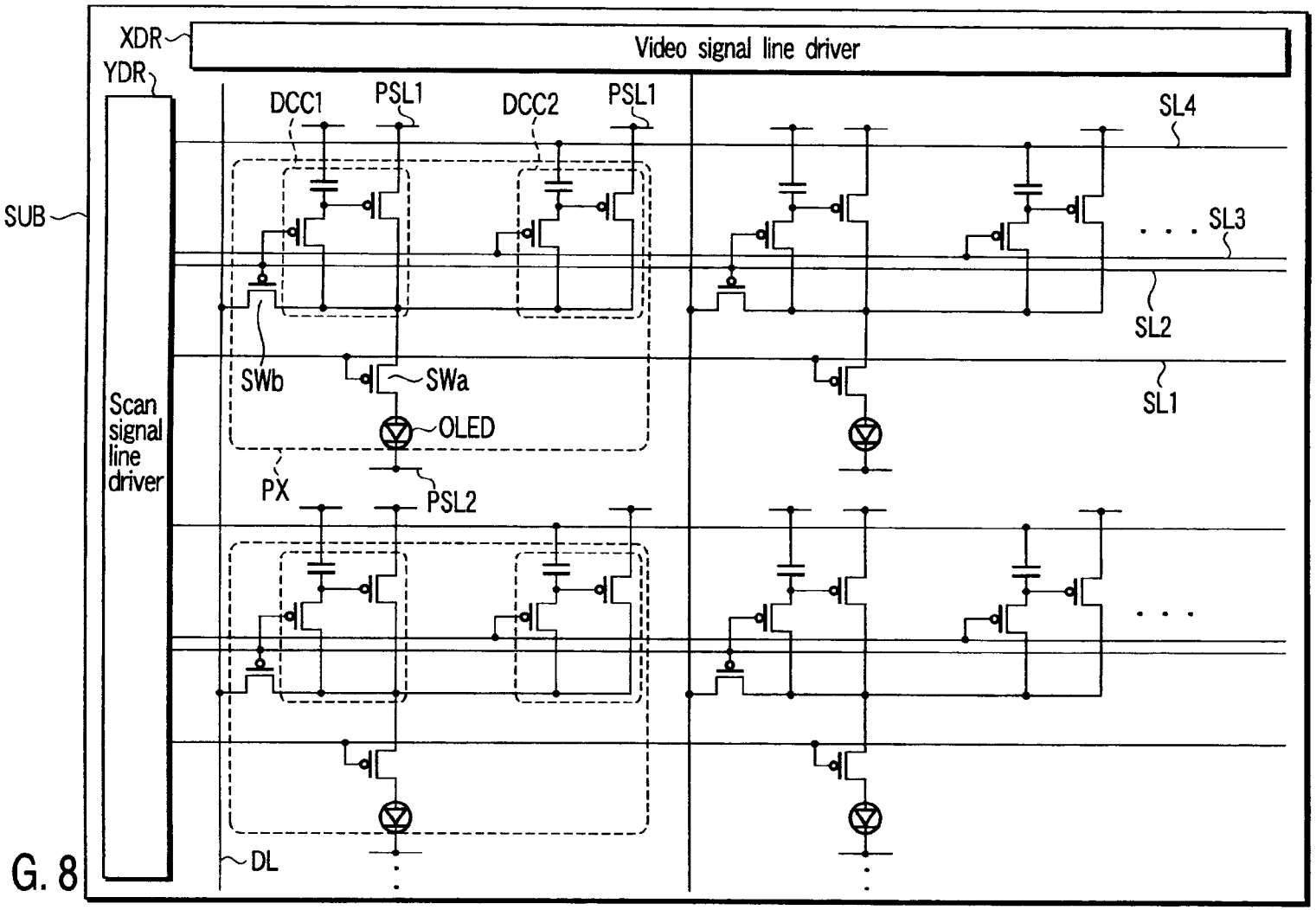
FIG. 8 is a plan view schematically showing a display according to a third embodiment of the present invention.

FIG. 8 is a plan view schematically showing a display according to the third embodiment of the present invention. FIG. 9 is an equivalent circuit diagram showing a pixel of the display shown in FIG. 8.

The display is an active matrix display, for example, an active matrix organic EL display, and includes a plurality of pixels PX. The display has the same structure as that of the display described with reference to FIGS. 4 and 5 except that the following configuration is employed.

In this display, the pixel PX does not includes the output control switches SWa1 and SWa2 and the video signal supply control switches SWb1 and SWb2. Instead, the pixel PX includes an output control switch SWa and a video signal supply control switch SWb.

The output control switch SWa and display element OLED are connected in series between the first drive current output terminal $ND_{DCout}$1 and second power supply terminal $ND_{ps}$1 in this order. Further, the output control switch SWa and display element OLED are connected in series between the second drive current output terminal $ND_{DCout}$2 and second power supply terminal $ND_{ps}$1 in this order. That is, the second drive current output terminal $ND_{DCout}$2 is connected to the first drive current output terminal $ND_{DCout}$1. A switching operation of the output control switch SWa is controlled by a first scan signal supplied from the scan signal line driver YDR via the first scan signal line SL1. As an example, the output control switch SWa is a p-channel thin-film transistor whose source, drain and gate are connected to the first drive current output terminal $ND_{DCout}$1, the anode of the display element OLED, and the first scan signal line SL1, respectively.

The video signal supply control switch SWb is connected between the video signal input terminal $ND_{VSin}$ and first drive current output terminal $ND_{DCout}$1. A switching operation of the video signal supply control switch SWb is controlled by a second scan signal supplied from the scan signal line driver YDR via the second scan signal line SL2. As an example, the video signal supply control switch SWb is a p-channel thin-film transistor whose source, drain and gate are connected to the first drive current output terminal $ND_{DCout}$1, the video signal input terminal $ND_{VSin}$, and the second scan signal line SL2, respectively.

The first diode-connecting switch SWc1 is connected between the drain and gate of the first drive control element DR1. A switching operation of the first diode-connecting switch SWc1 is controlled by the second scan signal supplied from the scan signal line driver YDR via the second scan signal line SL2. As an example, the first diode-connecting switch SWc1 is a p-channel thin-film transistor whose source, drain and gate are connected to the first drive current output terminal $ND_{DCout}$1, the gate of the first drive control element DR1, and the second scan signal line SL2.

The second diode-connecting switch SWc2 is connected between the drain and gate of the second drive control element DR2. A switching operation of the second diode-connecting switch SWc2 is controlled by a third scan signal supplied from the scan signal line driver YDR via the third scan signal line SL3. As an example, the second diode-connecting switch SWc2 is a p-channel thin-film transistor whose source, drain and gate are connected to the second drive current output terminal $ND_{DCout}2$, the gate of the second drive control element DR2, and the second scan signal line SL3.

The first capacitor C1 is connected between the gate of the first drive control element DR1 and the first reference potential terminal $ND_{RP}1$. As an example, the first reference potential terminal $ND_{RP}1$ is a constant-potential terminal.

The second capacitor C2 is connected between the gate of the second drive control element DR2 and the fourth scan signal line SL4. The electrode of the second capacitor C2 that is connected to the fourth scan signal line SL4 is supplied with a fourth scan signal from the scan signal line driver YDR via the fourth scan signal SL4.

Figure 10:
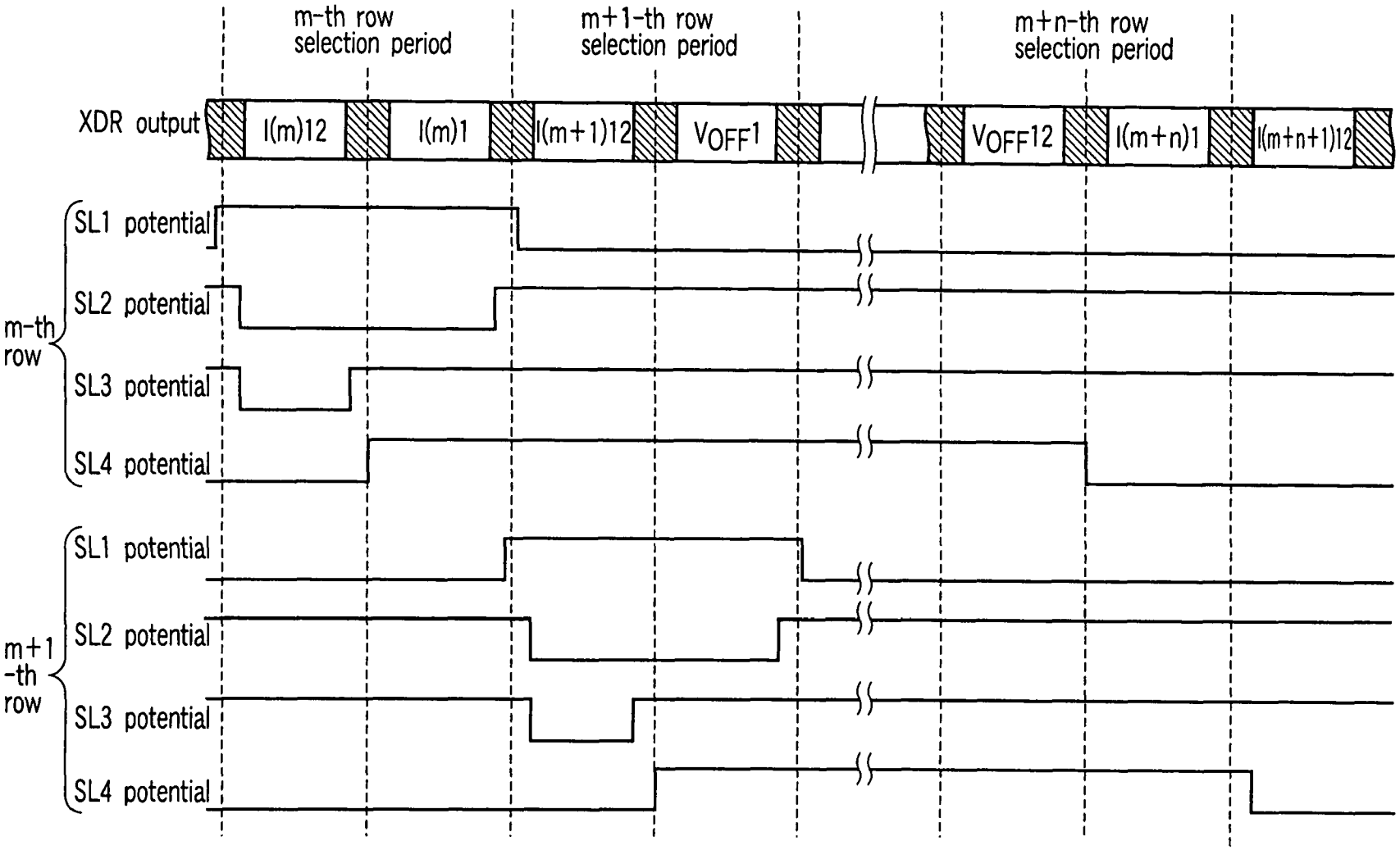
FIG. 10 is a timing chart schematically showing an example of a method of driving the display shown in FIG. 8.

FIG. 10 is a timing chart schematically showing an example of a method of driving the display shown in FIG. 8. FIG. 10 shows an example in which a gray level within a high gray level range is displayed on a pixel PX in the m-th row, and a gray level within a low gray level range is displayed on a pixel PX in the m+1-th row.

In FIG. 10, the abscissa denotes time, while the ordinate denotes potential. "XDR output" shows a signal that the video signal line driver XDR outputs to each video signal line DL. The waveforms indicated as "SL1 potential" to "SL4 potential" show potentials of the scan signal lines SL1 to SL4, respectively. Further, in FIG. 10, "I(m+k)2" and "I(m+k)1+2" represent magnitudes of currents or currents that sequentially flow during the "m+k-th row selection period" over which a pixel PX in the "m+k-th row" is selected, through the video signal line DL to which the above pixel PX is connected.

As an example, it is assumed that each brightness data is represented in 8 bits, and 256 gray levels are displayed. Further, it is assumed that the brightness data corresponding to the minimum gray level and the brightness data corresponding to the maximum gray level are represented as "00000000" and "11111111", respectively, the gray level range corresponding to the brightness data "00000000" to "00001111" is the low gray level range, and the gray level range corresponding to other brightness data is the high gray level range.

When a gray level within the high gray level range is to be displayed on a pixel PX in the m-th row, during the period over which the pixel PX in the m-th row is selected, that is, the m-th row selection period, the scan signal driver YDR outputs a first scan signal for opening the output control switch SWa to the first scan signal line SL1. During the write period over which the output control switch SWa is open, the following first and second write operations are executed sequentially.

In the first write operation, the scan signal line driver YDR outputs a second scan signal for closing the video signal supply control switch SWb and first diode-connecting switch SWc1 to the second scan signal line SL2. Further, the scan signal line driver YDR outputs a third scan signal for closing the second diode-connecting switch SWc2 to the third scan signal line SL3. At this time, the scan signal line driver YDR output a fourth scan signal for setting the potential of the fourth scan signal line SL4 at a first potential. In this state, the video signal line driver XDR outputs a second scan signal to the drive current control circuits DCC1 and DCC2 of the selected pixel PX via the video signal line DL. That is, a current I(m)12 is made to flow from the first power supply terminal $ND_{PS}1$ to the video signal line driver XDR.

Here, for the purpose of simplification, it is assumed that the drive control elements DR1 and DR2 are the same in characteristics. As an example, the brightness data corresponding to the gray level to be displayed is represented as "abcdefgh" in binary system. In this case, the magnitude of the current I(m)12 is set at, for example, a value 2×L×M-times the decimal value of "0000efgh" (L>0, M>1).

Then, the scan signal line driver YDR output a third signal for opening the second diode-connecting switch SWc2 to the third scan signal line SL3, so as to terminate the first write operation.

After finishing the first write operation, the second write operation is started.

In the second write operation, the scan signal line driver YDR outputs a fourth scan signal for setting the gate-to-source voltage of the second drive control element DR2 sufficiently higher than its threshold voltage to the fourth scan signal line SL4. The fourth scan signal in the second write operation is set sufficiently higher in potential than the fourth scan signal in the first write operation. Specifically, the difference between the second potential of the fourth scan signal line SL4 set by the second write operation and the first potential of the fourth scan signal line SL4 set by the first write operation should be large enough for the gate-to-source voltage of the second drive control element DR2 to be higher than its threshold voltage even in the case where the binary data "efgh" is "1111".

Then, in this state, the video signal line driver XDR outputs a first video signal to the first drive current control circuit DCC1 of the selected pixel PX via the video signal line DL and video signal supply control switch SWb. That is, a current I(m)1 is made to flow from the first power supply terminal $ND_{PS}1$ to the video signal line driver XDR. The magnitude of the current I(m)1 is set at, for example, a value L-times the decimal value of "abcd0000" (L>0).

Subsequently, the scan signal line driver YDR outputs a second scan signal for opening the video signal supply control switch SWb and first diode-connecting switch SWc1 to the second scan signal line SL2 so as to terminate the second write operation.

Then, the scan signal line driver YDR outputs a first scan signal for closing the output control switch SWa to the first scan signal line SL1. Closing the output control switch SWa terminates the write period.

The potential of the fourth scan signal line SL4 is set at the first potential in a part of the display period following the write period, while the potential of the fourth scan signal line SL4 is set at the second potential in the remainder of the display period. That is, the time period T2 over which the second drive control element can output the drive current $I_{drv}(m)2$ to the display element OLED is set to be shorter than the time period T1 over which the first drive control element DR1 can output the drive current $I_{drv}(m)1$ to the display element OLED. As an example, the potential of the fourth scan signal line SL4 is kept at the second potential until a certain time period has elapsed from closing the output control switch SWa, and is changed to the first potential at a certain point in time before the output control switch SWa1 is opened again. In addition, a ratio T2/T1 of the time period T2 with respect to the time period T1 is set at, for example, 1/N (N>1).

The first drive control element DR1 outputs the drive current $I_{drv}(m)1$ to the display element OLED at almost the same magnitude as that of the current I(m)1 only within the time period T1 of the vertical period. The second drive control element DR2 outputs the drive current $I_{drv}(m)2$ to the display element OLED at almost half the magnitude of the current I(m)12 only within the time period T2 of the vertical period. Therefore, the display element OLED emits light at luminance corresponding to the drive current $I_{drv}(m)1$ over the time period T1-T2 of the display period, and emits light at luminance corresponding to the sum of the drive current $I_{drv}(m)1$ and drive current $I_{drv}(m)2$ over the time period T2 of the display period.

An average value $I_{drv}(m)$ of the drive current that flows through the display element in the display period can be represented as $I_{drv}(m)1+1/N\times I_{drv}(m)2$. The magnitude of the drive current $I_{drv}(m)1$ is almost equal to that of the video signal I(m)1, and the magnitude of the drive current $I_{drv}(m)2$ is almost half the magnitude of the video signal I(m)12. The magnitude of the video signal I(m)1 is L-times the decimal value of the brightness data "abcd000", and the magnitude of the video signal I(m)12 is 2×L×M-times the decimal value of the brightness data "0000efgh". Therefore, when M is equal to N, the magnitude of the average $I_{drv}(m)$ of the drive current is almost equal to the value L-times the decimal value of the brightness data "abcdefgh".

Note that when the brightness data "abcdefgh" is "abcd0000", the third write operation may be executed instead of the first write operation. That is, the video signal line driver XDR may outputs the voltage signal $V_{OFF}2$ for setting the gate-to-source voltage of the second drive control element DR2 higher than its threshold voltage as the second video signal instead of outputting the current signal I(m)12.

The write period for the pixel PX in the m+1-th row starts after finishing the second write operation on the pixel PX in the m-th row.

During the write period for the pixel PX in the m+1-th row, the scan signal line driver YDR outputs the first scan signal for opening the output control switch SWa to the first scan signal line SL1. When a gray level within the gray level range corresponding to the brightness data from "00000001" to "00001111" is to be displayed on the pixel in the m+1-th row, the above first and fourth write operations are executed sequentially during the write period over which the output control switch SWa is open.

As an example, it is assumed that the brightness data corresponding to the gray level to be displayed on the pixel PX in the m+1-th row is represented as "0000efgh" in binary system. In the first write operation, the current signal I(m+1)12 as a video signal is written on the pixel PX in the m+1-th row by the method described above. The magnitude of the current I(m+1)12 is set at, for example, a value 2×L×M-times the decimal value of "0000efgh" (L>0, M>1).

After finishing the first write operation, the fourth write operation is started.

In the fourth write operation, the scan signal line driver YDR outputs the fourth scan signal for setting the potential of the fourth scan signal line SL4 at the second potential to the fourth scan signal line SL4.

Then, in this state, the video signal line driver XDR outputs the first video signal to the first drive current control circuit DCC1 of the selected pixel PX via the video signal line DL and video signal supply control switch SWb. That is, the video signal line driver XDR outputs the voltage signal $V_{OFF}1$ as the first video signal to the video signal line DL. Thus, the gate-to-source voltage of the first drive control element DR1 is set to be higher than its threshold voltage.

Subsequently, the scan signal line driver YDR outputs the second scan signal for opening the video signal supply control switch SWb and the first diode-connecting switch SWc1 to the second scan signal line SL2 so as to terminate the fourth write operation.

Then, the scan signal line driver YDR outputs the first scan signal for closing the output control switch SWa to the first scan signal line SL1. Closing the output control switch SWa terminates the write period.

The potential of the fourth scan signal line SL4 is set at the first potential in a part of the display period following the write period, while the potential of the fourth scan signal line SL4 is set at the second potential in the remainder of the display period. That is, the time period T2 over which the second drive control element can output the drive current $I_{drv}(m+1)2$ to the display element OLED is set to be shorter than the time period T1 over which the first drive control element DR1 can output the drive current $I_{drv}(m+1)1$ to the display element OLED.

The first drive control element DR1 can output the drive current $I_{drv}(m+1)1$ to the display element OLED only within the time period T1 of the vertical period. However, since the gate-to-source voltage of the first drive control element DR1 is higher than its threshold voltage, the magnitude of the current $I_{drv}(m+1)1$ is zero. The second drive control element DR2 outputs the drive current $I_{drv}(m+1)2$ to the display element OLED at almost half the magnitude of the current I(m+1)12 only within the time period T2 of the vertical period. Therefore, the display element OLED does not emit light over the time period T1-T2 of the display period, and emits light at luminance corresponding to the drive current $I_{drv}(m+1)2$ over the time period T2 of the display period.

An average value $I_{drv}(m+1)$ of the drive current that flows through the display element in the display period can be represented as $1/N\times I_{drv}(m+1)2$. The magnitude of the drive current $I_{drv}(m+1)2$ is almost half the magnitude of the video signal I(m+1)12. The magnitude of the video signal I(m+1)12 is 2×L×M-times the decimal value of the brightness data "0000efgh". Therefore, when M is equal to N, the magnitude of the average $I_{drv}(m)$ of the drive current is almost equal to the value L-times the decimal value of the brightness data "0000efgh".

Note that when the gray level corresponding to the brightness data "00000000" is displayed on a pixel PX, the third and fourth write operations may be executed sequentially in the write period. In this case, it is possible to prevent a drive current from flowing through the display element OLED during the display period.

As in the first and second embodiments, the driving method shown in FIG. 10 sets the time period T2 over which the second drive control element DR2 can output the second drive current shorter than the time period T1 over which the first drive control element DR1 can output the first drive current. Therefore, according to the present embodiment, all the gray levels can be displayed with high reproducibility, a heavy load does not applied onto the video signal line driver XDR, and deterioration of the display element OLED is less prone to occur.

Further, in the present embodiment, when the second video signal is written on the second drive current control circuit DCC2, an output of the video signal line driver is divided between the first drive current control circuit DCC1 and the second drive current control circuit DCC2. Therefore, according to the present embodiment, it is possible to make the output of the video signal line driver when the second video signal is written on the second drive current control circuit DCC2 larger than that in the first and second embodiments.

In addition, in the present embodiment, the number of the switches included in the pixel PX is smaller than that in the first and second embodiments. Thus, according to the present embodiment, the structure of the display can be simplified.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A display comprising:

pixels arranged in a matrix, each of the pixels comprising a display element, a first drive current control circuit which is supplied with a first video signal and outputs a first drive current to the display element at a magnitude corresponding to a magnitude of the first video signal, a second drive current control circuit which is supplied with a second video signal and outputs a second drive current to the display element at a magnitude corresponding to a magnitude of the second video signal, a first output control switch connected between the first drive current control circuit and the display element, and a second output control switch connected between the second drive current control circuit and the display element;

first video signal lines which are arranged correspondently with columns that the pixels form and to each of which the first drive current control circuit is connected; and second video signal lines which are arranged correspondently with the columns and to each of which the second drive current control circuit is connected, wherein the display is configured such that a ratio T1/T2 can be set to be larger than 1, where T1 represents a time period over which the first drive current control circuit outputs the first drive current to the display element, and T2 represents a time period over which the second drive current control circuit outputs the second drive current to the display element, wherein the first drive current control circuit comprises a first drive control element which includes a first control terminal, a first terminal connected to a first power supply terminal, and a second terminal outputting current at a magnitude corresponding to voltage between the first control terminal and the first terminal, a first video signal supply control switch connected between the first video signal line and the second terminal, a first diode connecting switch connected between the second terminal and the first control terminal, and a first capacitor, an electrode of the first capacitor being connected to the first control terminal, wherein the second drive current control circuit comprises a second drive control element including a second control terminal, a third terminal connected to the first power supply terminal, and a fourth terminal outputting current at a magnitude corresponding to voltage between the second control terminal and the third terminal, a second video signal supply control switch connected between the second video signal line and the fourth terminal, a second diode connecting switch connected between the fourth terminal and the second control terminal, and a second capacitor, an electrode of the second capacitor being connected to the second control terminal, wherein the first output control switch and the display element are connected in series between the second terminal and a second power supply terminal in this order, and wherein the second output control switch and the display element are connected in series between the fourth terminal and the second power supply terminal in this order.

2. The display according to claim 1, further comprising first scan signal lines which are arranged correspondently with rows that the pixels form and each of which supplies the first output control switch with a first scan signal for controlling its switching operation, second scan signal lines which are arranged correspondently with the rows and each of which supplies the second output control switch with a second scan signal for controlling its switching operation, and third scan signal lines which are arranged correspondently with the rows and each of which supplies the switches included in the first and second drive current control circuits with a third scan signal for controlling their switching operations.

3. A display comprising:

pixels arranged in a matrix, each of the pixels comprising a display element, a first drive current control circuit which is supplied with a first video signal and outputs a first drive current to the display element at a magnitude corresponding to a magnitude of the first video signal, a second drive current control circuit which is supplied with a second video signal and outputs a second drive current to the display element at a magnitude corresponding to a magnitude of the second video signal, a first output control switch connected between the first drive current control circuit and the display element, and a second output control switch connected between the second drive current control circuit and the display element; and video signal lines which are arranged correspondently with rows that the pixels form and to each of which the first and second drive current control circuits are connected, wherein each of the first and second drive current control circuits comprises a drive control element which includes a control terminal, a first terminal connected to a first power supply terminal, and a second terminal outputting current at a magnitude corresponding to voltage between the control terminal and the first terminal, a video signal supply control switch connected between the video signal line and the second terminal, a diode connecting switch connected between the second terminal and the control terminal, and a capacitor, an electrode of the capacitor being connected the control terminal, wherein the first output control switch and the display element are connected in series between the second terminal of the drive control element included in the first drive current control circuit and the a second power supply terminal in this order, and wherein the second output control switch and the display element are connected in series between the second terminal of the drive control element included in the second drive current control circuit and the second power supply terminal in this order.

4. The display according to claim 3, further comprising first scan signal lines which are arranged correspondently with rows that the pixels form and each of which supplies the first output control switch with a first scan signal for controlling its switching operation, second scan signal lines which are arranged correspondently with the rows and each of which supplies the second output control switch with a second scan signal for controlling its switching operation, third scan signal lines which are arranged correspondently with the rows and each of which supplies the switches included in the first drive current control circuit with a third scan signal for controlling their switching operations, and fourth scan signal lines which are arranged correspondently with the rows and each supplies the switches included in the second drive current control circuit with a fourth scan signal for controlling their switching operations.

5. A display comprising pixels arranged in a matrix, each of the pixels comprising:

a display element;

a first drive current control circuit which is supplied with a first video signal and outputs a first drive current to the display element at a magnitude corresponding to a magnitude of the first video signal; and a second drive current control circuit which is supplied with a second video signal and outputs a second drive current to the display element at a magnitude corresponding to a magnitude of the second video signal, wherein the display is configured such that a ratio T1/T2 can be set to be larger than 1, where T1 represents a time period over which the first drive current control circuit outputs the first drive current to the display element, and T2 represents a time period over which the second drive current control circuit outputs the second drive current to the display element, and wherein each of the first and second drive current control circuits comprises a drive control element which includes a control terminal, a first terminal connected to a first power supply terminal, and a second terminal outputting current at a magnitude corresponding to voltage between the control terminal and the first terminal, a diode connecting switch connected between the second terminal and the control terminal, and a capacitor, an electrode of the capacitor being connected to the control terminal, wherein another electrode of the capacitor included in the second drive current control circuit is connected to a scan signal input terminal.

6. The display according to claim 5, each of the pixels further comprises an output control switch, the output control switch and the display element being connected in series between the second terminal and a second power supply terminal in this order.

7. The display according to claim 6, further comprising video signal line arranged correspondently with columns that the pixels form, wherein each of the pixels further comprises a video signal supply control switch connected between the video signal line and the second terminal.

8. The display according to claim 7, further comprising first scan signal lines which are arranged correspondently with rows that the pixels form and each of which supplies the output control switch with a first scan signal for controlling its switching operation, second scan signal lines which are arranged correspondently with the rows and each of which supplies the video signal supply control switch and the diode connecting switch included in the first drive current control circuit with a second scan signal for controlling their switching operations, third scan signals which are arranged correspondently with the rows and each of which supplies the diode connecting switch included in the second drive current control circuit with a third scan signal for controlling its switching operation, and fourth scan signal lines which are arranged correspondently with the rows, the capacitor included in the second drive current control circuit being connected between the fourth scan signal and the control terminal.

9. The display according to claim 7, further comprising a video signal line driver to which the video signal lines are connected, the video signal line driver including a current source and a voltage source.

* * * * *